US007832888B2

(12) United States Patent
Demarest et al.

(10) Patent No.: US 7,832,888 B2
(45) **Date of Patent: *Nov. 16, 2010**

(54) METHOD OF DISPLAYING ILLUMINATED PRODUCTS

(75) Inventors: Scott W. Demarest, Caledonia, WI (US); Simon M. Conway, Burlington, WI (US); Scott D. Walter, Twin Lakes, WI (US); Justin Boyd Petro, Austin, TX (US); Paul J. Burke, Austin, TX (US); Ronald R. Dir, Sturtevant, WI (US); Kara J. Peery, Milwaukee, WI (US); Michelle Houp, Austin, TX (US)

(73) Assignee: S.C. Johnson & Son, Inc., Racine, WI (US)

( * ) Notice: Subject to any disclaimer, the term of this patent is extended or adjusted under 35 U.S.C. 154(b) by 258 days.

This patent is subject to a terminal disclaimer.

(21) Appl. No.: 12/132,446

(22) Filed: Jun. 3, 2008

(65) Prior Publication Data

US 2009/0296385 A1 Dec. 3, 2009

(51) Int. Cl.
*A47F 11/10* (2006.01)
*H05B 37/02* (2006.01)

(52) U.S. Cl. ..... 362/125; 362/85; 362/231; 312/223.5; 315/295

(58) Field of Classification Search ..... 362/85, 362/125, 231, 233; 312/102, 223.5, 237; 315/295, 312, 324

See application file for complete search history.

(56) References Cited

U.S. PATENT DOCUMENTS 3,821,538 A 6/1974 Jonathan et al.
4,142,216 A 2/1979 Goss et al.
D264,277 S 5/1982 Poelvoorde et al.
4,378,884 A 4/1983 Anderson
4,442,942 A 4/1984 Cuminale et al.
4,611,717 A 9/1986 Hutson
4,815,610 A 3/1989 Borick et al.
D335,228 S 5/1993 Barthelmess et al.
D335,592 S 5/1993 Barthelmess et al.
5,277,486 A 1/1994 Bustos
5,458,411 A 10/1995 Moss
5,555,991 A 9/1996 Hart
5,597,114 A 1/1997 Kramedjian et al.
5,599,079 A 2/1997 Ranno et al.
5,660,026 A 8/1997 Kinigakis et al.
5,669,683 A 9/1997 Moss
5,680,744 A 10/1997 Kramedjian et al.

(Continued)

*Primary Examiner*—John A Ward

(57) ABSTRACT

A method of displaying and merchandising a product that that provides customer interaction and product synchronization is disclosed. The method provides a product display that may include an upright display member having an illuminating member and lighting niches through which dynamic light shows may be projected. A product may be positioned in a lighting niche. A product experience shelf may also be coupled to the upright display member. The product experience shelf may include translucent recesses for holding and illuminating products and or samples of products. The product experience shelf may also incorporate an illuminated ring or border lining the outer edge of each recess for additional lighting effects. The method also provides an interactive customer interface that allows customers to adjust a control module which coordinates synchronized dynamic light shows throughout the display. The customer interface may also be illuminated and positioned on the product experience shelf. Furthermore, the method provides synchronization of dynamic light shows with the products on display.

20 Claims, 9 Drawing Sheets

U.S. PATENT DOCUMENTS

| | | | | |
|---|---|---|---|---|
| 5,722,747 | A | 3/1998 | Baron | |
| 5,882,209 | A | 3/1999 | Gabig et al. | |
| 5,918,954 | A | 7/1999 | Papadakis et al. | |
| 6,155,438 | A | 12/2000 | Close | |
| 6,227,386 | B1 | 5/2001 | Close | |
| 6,607,275 | B1 | 8/2003 | Cimini et al. | |
| 6,651,828 | B2 | 11/2003 | Dimattio et al. | |
| 6,777,654 | B1 | 8/2004 | Greenburg | |
| 6,808,152 | B2 | 10/2004 | Fell | |
| 6,827,448 | B2 | 12/2004 | Cimini et al. | |
| 6,850,208 | B1 | 2/2005 | Ferrante | |
| 6,896,521 | B2 | 5/2005 | Underhill et al. | |
| 7,000,881 | B2 | 2/2006 | Fell | |
| 7,025,217 | B2 | 4/2006 | Crown et al. | |
| 7,048,131 | B2 | 5/2006 | Gay et al. | |
| 7,163,109 | B2 | 1/2007 | Wells et al. | |
| D547,569 | S | 7/2007 | Yan | |
| 7,391,337 | B2 | 6/2008 | St-Germain | |
| 7,665,860 | B2 * | 2/2010 | Demarest et al. | 362/125 |
| 2005/0263353 | A1 | 12/2005 | Jennings | |
| 2005/0279579 | A1 | 12/2005 | Milk et al. | |
| 2007/0042614 | A1 | 2/2007 | Marmaropoulos et al. | |
| 2007/0235263 | A1 | 10/2007 | Legault et al. | |
| 2008/0121563 | A1 | 5/2008 | Polvere et al. | |
| 2008/0136356 | A1 | 6/2008 | Zampini et al. | |
| 2008/0198600 | A1 | 8/2008 | Crandell et al. | |

* cited by examiner

METHOD OF DISPLAYING ILLUMINATED PRODUCTS

FIELD OF THE DISCLOSURE

The present disclosure generally relates to methods of displaying and merchandising products in retail establishments, and more particularly, relates to a method of providing a customer interactive display for showcasing multisensory products.

BACKGROUND OF THE DISCLOSURE

Promoting merchandise within a retail environment using product displays and fixtures are well known in the art. Promotional displays serve to catch the attention of customers, spark an interest in a product, and to eventually persuade customers to purchase the product. Displays attempt to accomplish this in any one of a variety of ways and may take any form. But in particular, product displays need to set a product apart from its competition within a retail environment, without being too excessive or intrusive to customers.

Some of the more common methods of merchandising use images, posters, signage or banners to promote a product. Because of the widespread use of such imagery, however, such displays tend to be too plain and blend into a retail setting. To further set a product apart from its surroundings, some displays may employ sound effects, music, video or other media. However, the volume on such displays may be set too low for the environment to effectively advertise the product. Alternatively, the continuous playback of such media may prove to be too loud, annoying, and deter rather than attract customers. Although some displays also provide motion sensors to play such media only when customers are nearby, the sensors are often too sensitive and do not help to that effect. While there are several ways to promote a product at the point of sale, the more effective methods tend to provide alluring displays that also allow customers to fully sample the product. More specifically, a method of displaying a product may provide a proper showcase and a demonstration, or dummy model, of a particular product for customers to evaluate and test in the store before purchase.

With respect to lighting products, a demonstration model of the product may be displayed within the store. However, displays promoting lighting products are generally uninteresting, unattractive, and offer customers limited, if any, interaction with the device. Furthermore, typical retail stores do not provide an elaborate display for only one product or manufacturer. Specifically, if a demonstration model is provided for one lighting unit it will almost certainly be surrounded by several other similar displays for competing units grouped into the same aisle, department, or the like. This arrangement makes it difficult to set a particular lighting product apart from the competition. Additionally, light from surrounding units and strong overhead lights typically found in retail stores make it extremely difficult to evaluate the illumination of a single lighting product.

Methods of promoting fragrance objects similarly provide demonstration bottles or testers for sampling. Testers are bottles of perfume that customers can spray into the air or onto a sampling card at the point of sale to sample a scent. However, multiple testers from different manufacturers are usually grouped together in a single area designated for sampling. As with displays for lighting products, this makes it difficult to distinguish and advertise one particular fragrance product over the competition. Furthermore, testers are generally provided only for perfumes and colognes, but not for fragrance dispensers designed for the home. Consequently, when selecting a fragrance for home use, customers are forced to guess by reading the description on package labels, smelling the packaging, or opening the package in the store.

Therefore, multiple needs exist for an effective method of displaying and merchandising products that provides an interesting destination within a retail environment as well as proper demonstrations of products associated with lighting, fragrance, or the like. More specifically, needs exist for a method of displaying products that attracts customers from a distance, sets the products apart from the competition, substantially blocks unwanted ambient light, and also provides customer interaction. The ideal method of displaying should also be cost-conscious and provide a display that may be easily installed and readily adaptable to new products or changing retail environments. The display provided by such a method should also require minimal space and mountable on existing shelving units.

SUMMARY OF THE DISCLOSURE

In accordance with one aspect of the disclosure, a method of displaying a product comprises the steps of providing an upright display member having at least one lighting niche, a first dynamic light source disposed in the at least one lighting niche for projecting light onto the product, a second dynamic light source disposed in the product for illuminating the product, a control module with a memory operatively associated with the first and second dynamic light sources, and an interactive customer interface for receiving customer input; positioning the product inside the at least one lighting niche; supplying power to the control module; reading one or more light shows stored on the memory; controlling the first and second dynamic light sources to illuminate according to the one or more light shows; and adjusting the one or more light shows in response to the customer input.

In accordance with another aspect of the disclosure, a method of displaying a lighting product comprises the steps of providing an upright display member having at least one lighting niche, a first dynamic light source disposed in the at least one lighting niche, a control module with a memory operatively associated with the first dynamic light source, and an interactive customer interface for receiving customer input; positioning the product inside the at least one lighting niche; supplying power to the control module; reading one or more light shows stored on the memory; controlling the first dynamic light source to illuminate according to the one or more light shows; and adjusting the one or more light shows in response to the customer input.

In accordance with another aspect of the disclosure, a method of displaying products comprises the steps of providing an upright display member having at least one lighting niche, a product experience shelf, a first dynamic light source disposed in the at least one lighting niche, a second dynamic light source disposed in the product experience shelf, a control module with a memory operatively associated with the first and second dynamic light sources, and an interactive customer interface for receiving customer input; positioning a first product inside the at least one lighting niche and a second product on the product experience shelf, supplying power to the control module; reading one or more light shows stored on the memory; controlling the first and second dynamic light sources to illuminate according to the one or more light shows; synchronizing the one or more light shows between the first and second dynamic light sources; and adjusting the one or more light shows in response to the customer input.

In accordance with another aspect of the disclosure, a method of merchandising products comprises the steps of providing an upright display member having at least one lighting niche, a product experience shelf, an illuminating member disposed on top of the upright member, a first dynamic light source disposed in the at least one lighting niche, a second dynamic light source disposed in the product experience shelf, a third dynamic light source disposed in the illuminating member, a control module with a memory operatively associated with the first, second and third dynamic light sources, and an interactive customer interface for receiving customer input; positioning a first product inside the at least one lighting niche and a second product on the product experience shelf; supplying power to the control module; reading one or more light shows stored on the memory; controlling the first, second and third dynamic light sources to illuminate according to the one or more light shows; synchronizing the one or more light shows between the first, second and third dynamic light sources; and adjusting the one or more light shows in response to the customer input.

These and other aspects of this disclosure will become more readily apparent upon reading the following detailed description when taken in conjunction with the accompanying drawings.

Figure 1:
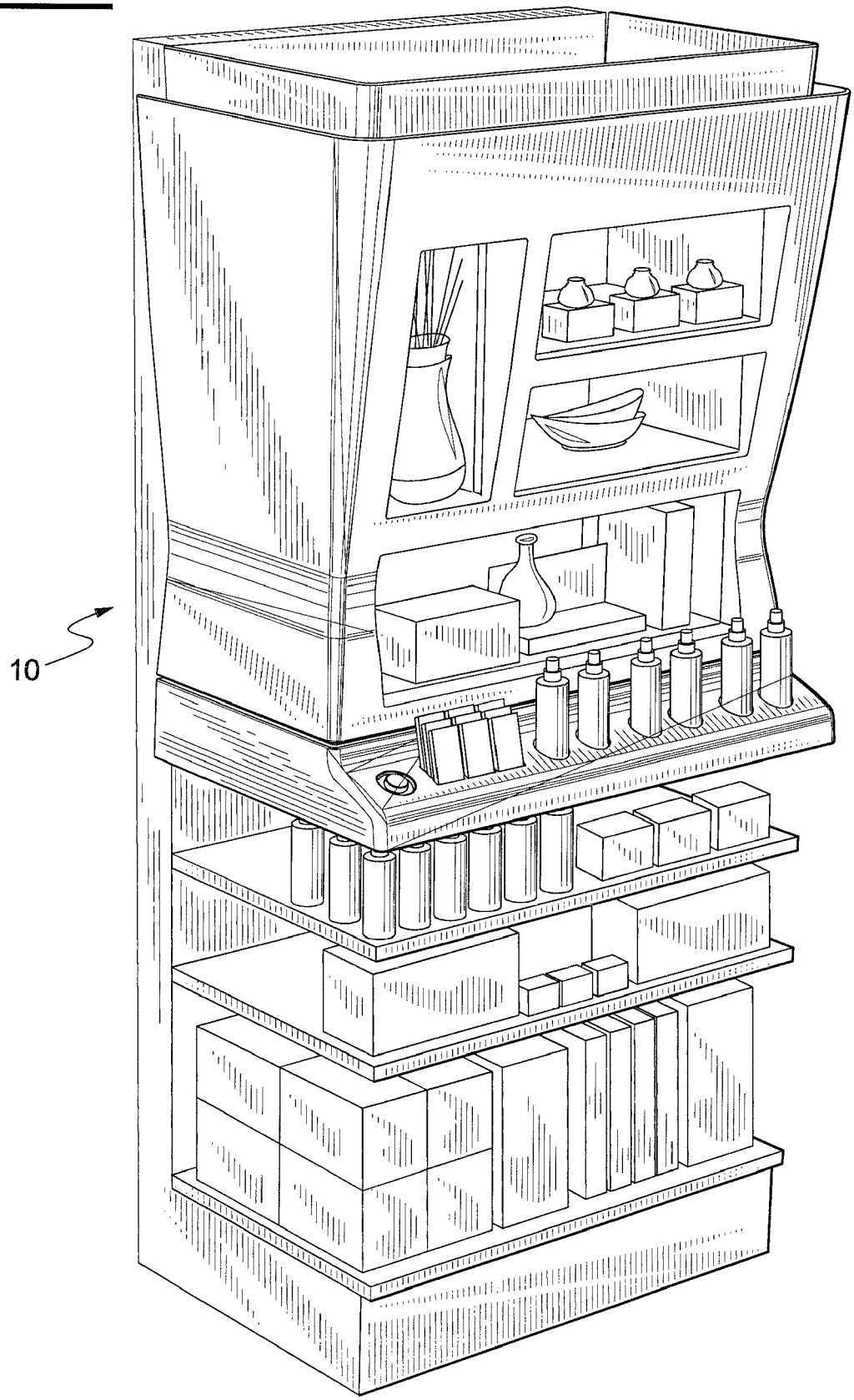
FIG. 1 is a perspective view of an exemplary product display provided by the method of the disclosure.

While the present disclosure is susceptible to various modifications and alternative constructions, certain illustrative embodiments thereof have been shown in the drawings and will be described below in detail. It should be understood, however, that there is no intention to limit the present invention to the specific forms disclosed, but on the contrary, the intention is to cover all modifications, alternative constructions, and equivalents falling with the spirit and scope of the present invention.

DETAILED DESCRIPTION

Referring now to the drawings and with particular reference to FIG. 1, an exemplary product display provided by a method of showcasing products is provided and referred to as reference number 10. It is understood that the teachings of the disclosure can be used to arrange methods of displaying products and corresponding displays above and beyond that specifically disclosed below. One of ordinary skill in the art will readily understand that the following are exemplary embodiments.

A method of displaying a product may provide an illuminating product display 10, as shown in FIG. 1. The illumination product display 10 may showcase a variety of products and provide an attractive destination within a retail establishment. Moreover, the illuminating display 10 may serve to provide customers with interactive sampling of products such as lighting products, fragrance products, or any other product, at the point of sale. The display 10 may be a standalone structure, or installed on existing shelves so as to facilitate installation and to reduce costs. More specifically, the display 10 may be provided on a wall, a countertop, an endcap or a midsection of a shelving structure, or configured using other means commonly used in retail environments. Furthermore, the display 10 may be constructed of subcomponents, or modules, that may be interchanged with one another within a single display, or with other displays. Such modular designs may provide the display 10 with the flexibility to be installed in almost any retail setting and to accommodate almost any product with ease.

Figure 2:
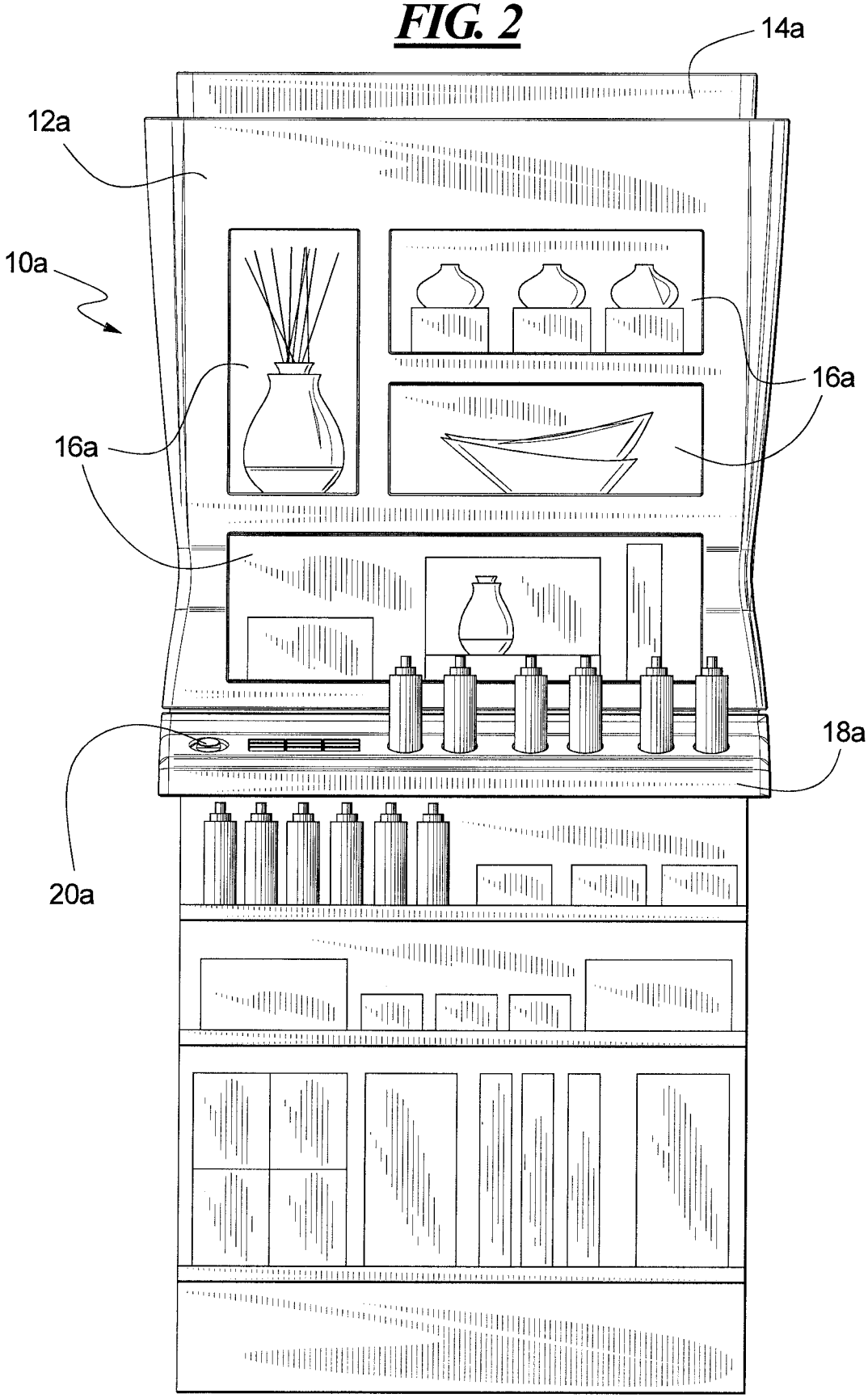
FIG. 2 is a front plan view of another product display.

Referring now to FIG. 2, another illuminating product display 10*a* for use as an endcap in a retail environment is provided. In general, the display 10*a* may be situated so as to leave some shelves unoccupied. The unoccupied shelves may be used to stock the products presented within the display 10*a* so that customers do not have to look far for an item they have decided to purchase. The display 10*a* may also provide several elements that serve to enhance or reinforce product features, as well as attract the attention of customers. Specifically, the display 10*a* may include an upright display member 12*a* having an illuminating member 14*a*, such as a crown, lighting niches 16*a*, a product experience shelf 18*a*, such as a fragrance bar, and an interactive customer interface 20*a* for controlling dynamic light output. Furthermore, these elements may be formed as interchangeable and or removable modules within the display 10*a*. For instance, the lighting niches 16*a* and or the product experience shelf 18*a* may be rearranged to form a different configuration than shown in FIG. 2. Additionally, the illuminating member 14*a*, one or more lighting niches 16*a*, or the product experience shelf 18*a* may be omitted from the display 10*a*.

Figure 3:
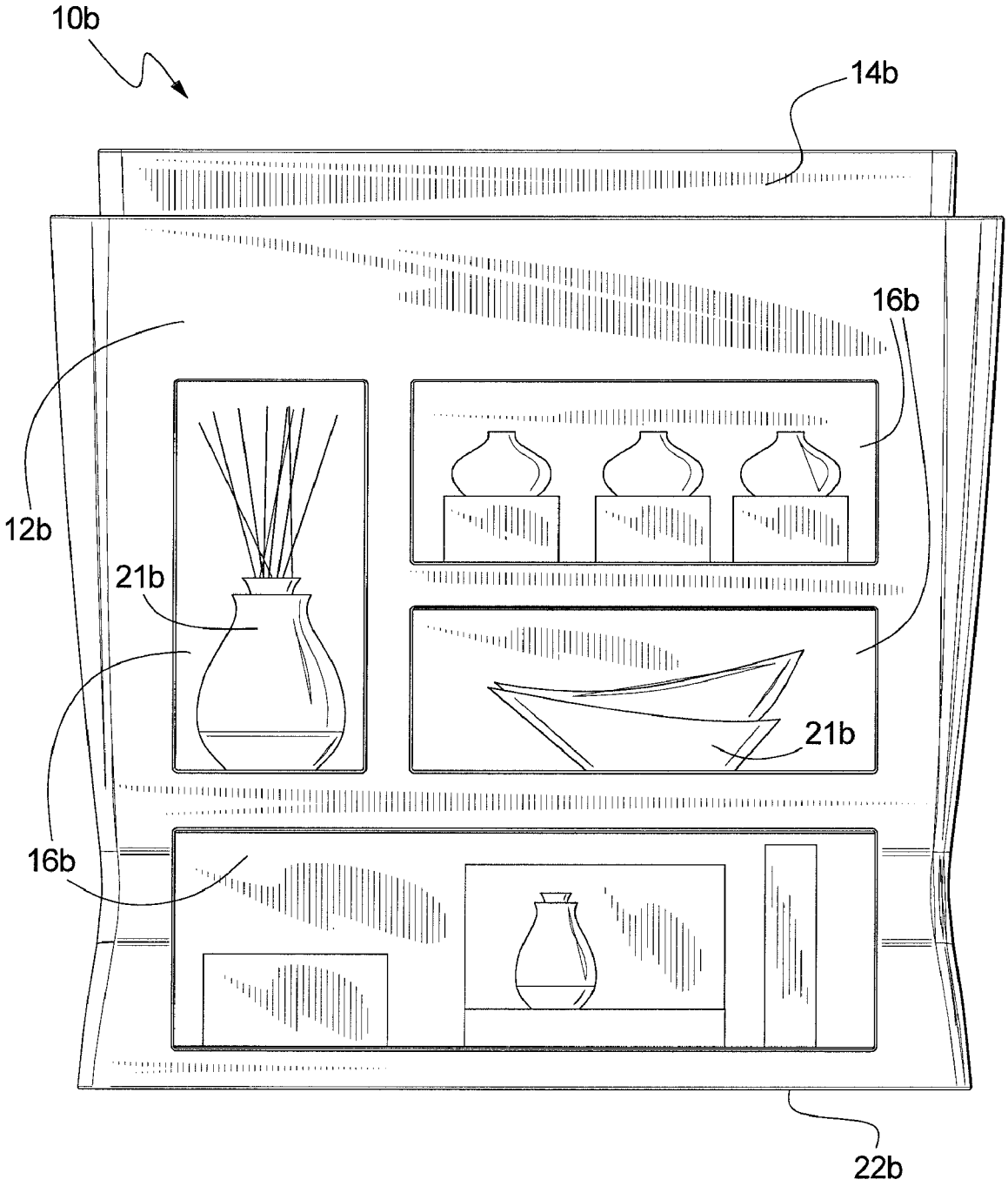
FIG. 3 is a front plan view of an upright display member with an illuminating member and lighting niches.

Turning to FIG. 3, another upright display member 12*b* is provided with an illuminating member 14*b* and lighting niches 16*b*. As previously described, the illuminating member 14*b* and the lighting niches 16*b* may be modular in design such that they may be rearranged on the upright member 12*b* or omitted according to preference. The illuminating member 14*b* of FIG. 3 may essentially be a translucent diffuser enclosing a dynamic light source and disposed as a crown on top of the upright display member 12*b*. Light from the crown 14*b* may be projected in an upward direction through the diffuser to attract customers from a distance. Alternatively, similar illuminating members 14*b* may be positioned on other areas of the upright display member 12*b*, for example, on the front, along the sides, along the edges, or any combinations thereof. Lighting niches 16*b* may serve to properly showcase a product, or object 21*b*, within a brightly lit retail environment. Specifically, lighting niches 16*b* may be arranged to substantially block bright illumination light typically used in retail environments which may wash out light produced by the display 10*b* and or the object 21*b*. The lighting niches 16*b* may further provide its own dynamic light source to illuminate the interior of the niche 16*b* and an object 21*b* provided therein. Alternatively, the object 21*b* may be a lighting object which provides its own dynamic light source to produce a soothing glow from within the product.

Figure 4:
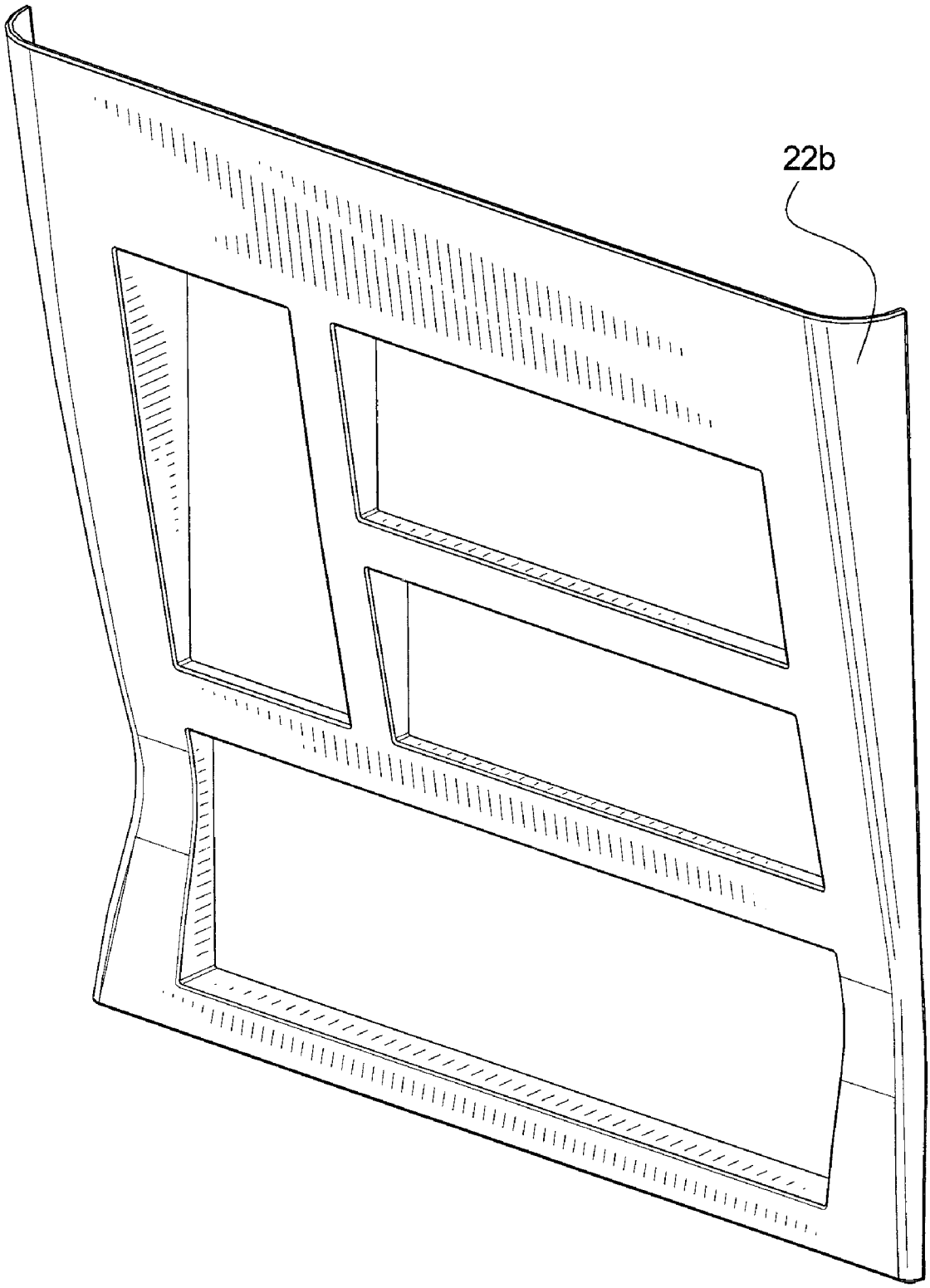
FIG. 4 is a perspective view of a replaceable cover for an upright display member.

Still referring to FIG. 3, the upright display member 12*b* may further include a cover 22*b* disposed on the front of the upright display member 12*b*. The cover 22*b* may be configured to expose the lighting niches 16*b* and or additional storage or shelving compartments. Alternatively, the cover 22*b* may also provide room for company logos, advertisement messages and or other graphics specific to a product line. As illustrated in FIG. 4, the cover 22*b* may also be replaceable and made of a substantially thin material such as paper, cardboard, plastic, plexiglass, glass, or the like. Additionally, the cover 22*b* may be detachably coupled to the front of an upright display member 12*b* via clips, hinges, screws, straps, Velcro®, or other similar fasteners. Interchangeable covers 22*b* may allow for a quick and easy replacement of an older outdated cover with a new cover having updated graphics. Such an arrangement may provide a display 10*b* readily adaptable to changing products and or retail environments.

Figure 5A:
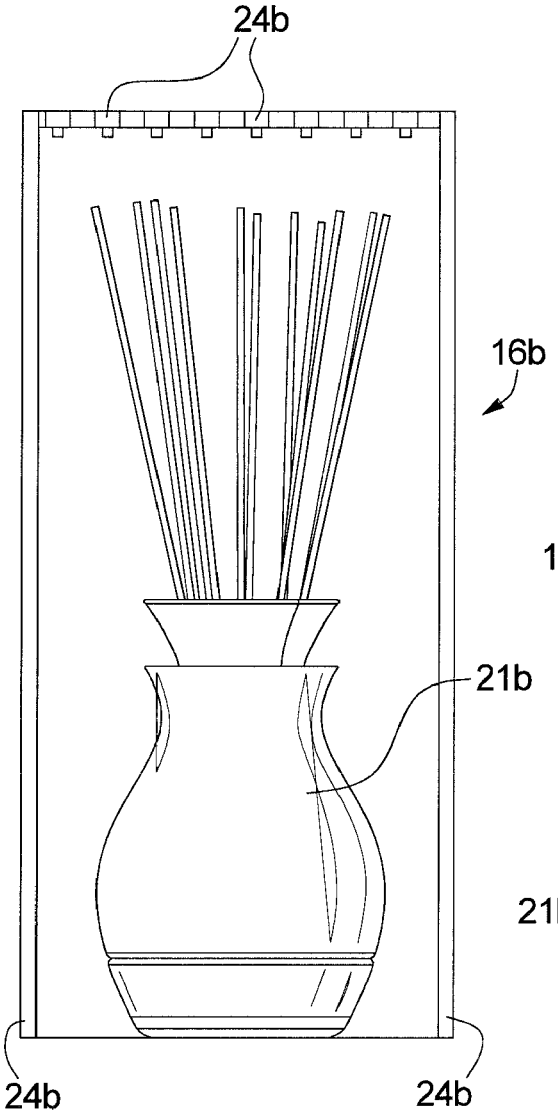
FIGS. 5A, 5B and 5C are respective front, side and top plan views of a lighting niche.
Figure 5B:
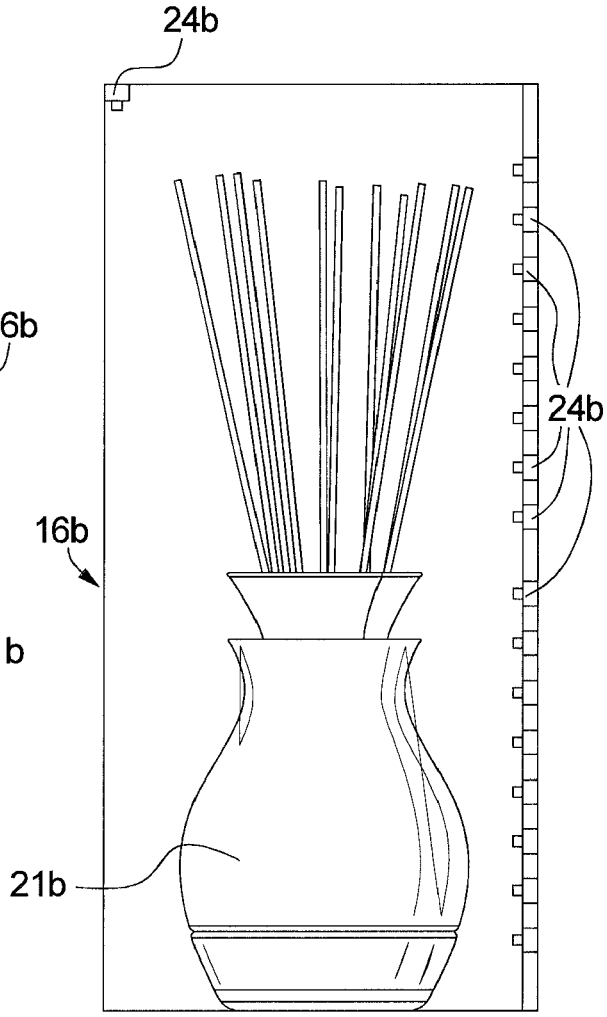
Figure 5C:
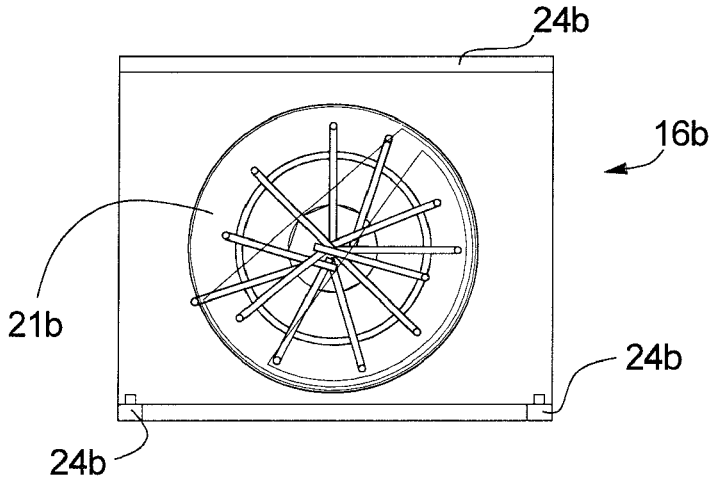

Referring now to FIGS. 5A-5C, various views of an exemplary lighting box, or niche 16*b*, is provided. The lighting niche 16*b* may employ one or more dynamic light sources to illuminate the interior of the niche 16*b*. For instance, the lighting niche 16*b* may employ a plurality of colored light emitting diodes (LEDs) 24*b* for projecting light onto or through an object 21*b*. As shown in the front and side views of FIGS. 5A and 5B, respectively, a horizontal row of LEDs 24*b* may be distributed across the top and towards the back of the lighting niche 16*b* to project light down onto an object 21*b*. As shown in the side and top views of FIGS. 5B and 5C, respectively, the lighting niche 16*b* may further include two vertical columns of LEDs 24*b* toward the front of the niche 16*b* to illuminate the front of an object 21*b*. Alternatively, the lighting niche 16*b* may employ other lighting arrangements and dynamic light sources other than LEDs 24*b* to optimize the aesthetic appearance of the object 21*b*.

Figure 6:
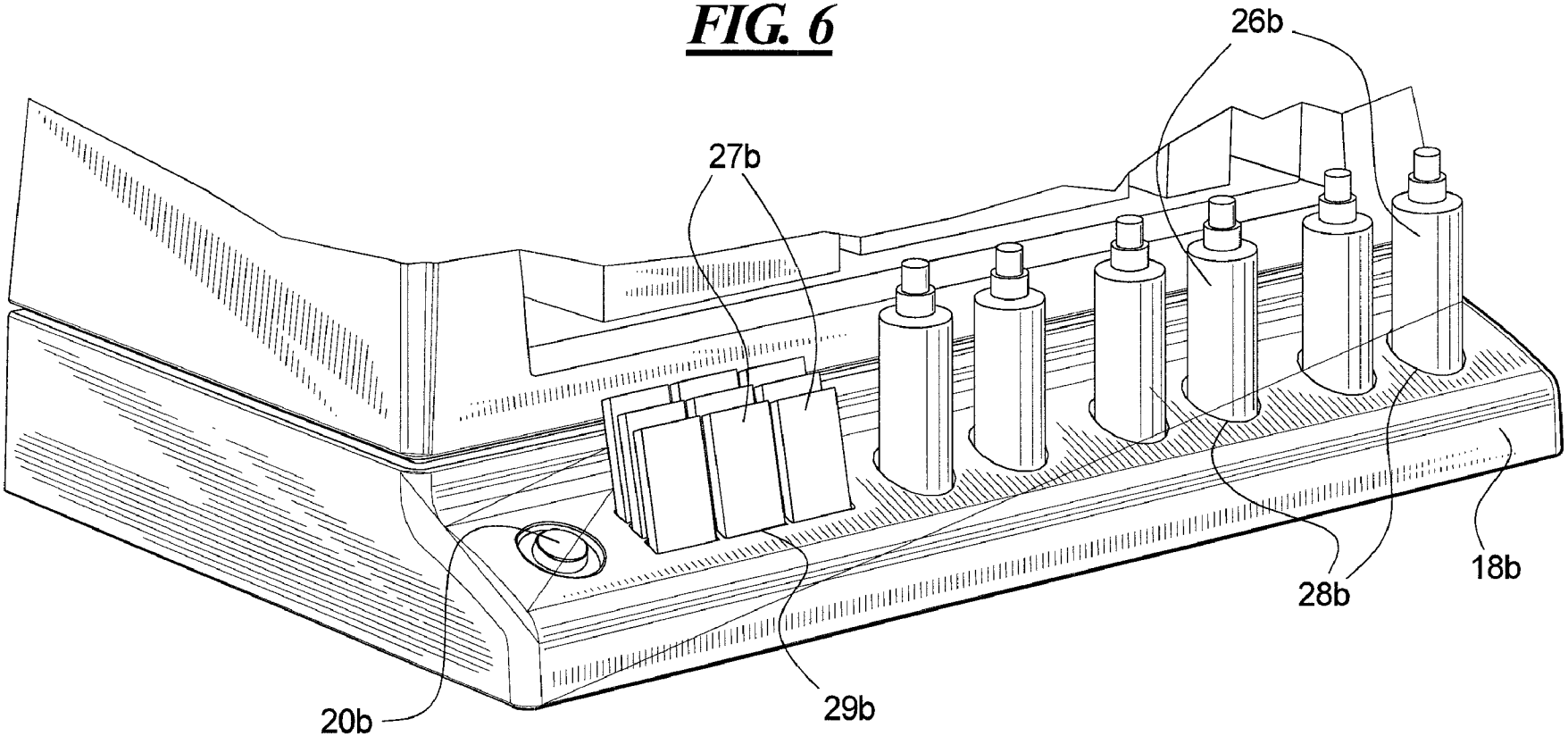
FIG. 6 is a perspective view of an exemplary product experience shelf.

Turning to FIG. 6, an exemplary product experience shelf 18*b* that may be used with the illuminating product display 10*b* of FIG. 3 is provided. The product experience shelf 18*b* may be in the form of a fragrance bar, as shown in FIG. 6, to provide a surface upon which fragrance products, or objects 26*b*, may rest. Alternatively, the product experience shelf 18*b* may include a product test panel, sampling counter, product demonstrations and or other means for readily displaying products to a customer. The products to be displayed on the product experience shelf include but are not limited to fragrances, personal care products, lighting products, cleaning products and the like. As a fragrance bar, the product experience shelf 18*b* may include recesses 28*b* formed thereon and may be shaped to receive specific products or objects 26*b* related to fragrance. The product experience shelf 18*b* may also provide additional recesses 29*b* for product samples 27*b*, for example, fragrance sampling cards, or the like. One or more dynamic light sources may also be disposed inside the product experience shelf 18*b* and configured to illuminate the recesses 28*b*, 29*b* and project light therethrough. More specifically, the dynamic light sources may be used to illuminate the samples 27*b*, as well as any container or contents of each product 26*b*. Dynamic light sources within the product experience shelf 18*b* may also project light downward onto unoccupied shelves situated below the display 10*b*. Accordingly, the product experience shelf 18*b*, the products 26*b*, samples 27*b*, the recesses 28*b*, 29*b*, or any combination thereof, may be formed of a clear or translucent material so as to transmit or diffuse the light emitted by the dynamic light sources from within the product experience shelf 18*b*. The product experience shelf 18*b* may also incorporate a translucent ring or border lining the outer edge of the recesses 28*b*, 29*b* for creating additional lighting effects. The light emitted may be provided by colored LEDs, lasers, or any other dynamic light source commonly known in the art.

The product experience shelf 18*b* may provide an interactive customer interface 20*b* that allows customers to adjust the dynamic light output of an illuminating product display 10*b*. The customer interface 20*b* may be provided in many different forms including but not limited to dials, keypads, switches, touchscreens and or similar input devices, operatively associated with a control module, which in turn, controls the output of all dynamic light sources disposed throughout the illuminating product display 10*b*. Additional dynamic light sources within the product experience shelf 18*b* may be configured to add illumination underneath and or around the customer interface 20*b*. The customer interface 20*b* may also include a translucent ring or border lining the outer edge of the input device for additional lighting effects. Alternatively, the interactive customer interface 20*b* may be disposed on the cover 22*b*, within a lighting niche 16*b*, or on any other portion of the display 10*b* of FIG. 3.

In other related embodiments, more than one interactive customer interface 20*b* may be provided on the product experience shelf 18*b* to allow independent adjustment of subgroups of the dynamic light sources. For instance, a first interface may adjust the dynamic light output within a lighting niche 16*b* while a second interface may adjust the dynamic light output of a lighting product or object 21*b* positioned therein. The display 10*b* may also provide additional customer interfaces 20*b* so as to allow multiple users to independently control light shows at one display setting.

Figure 7:
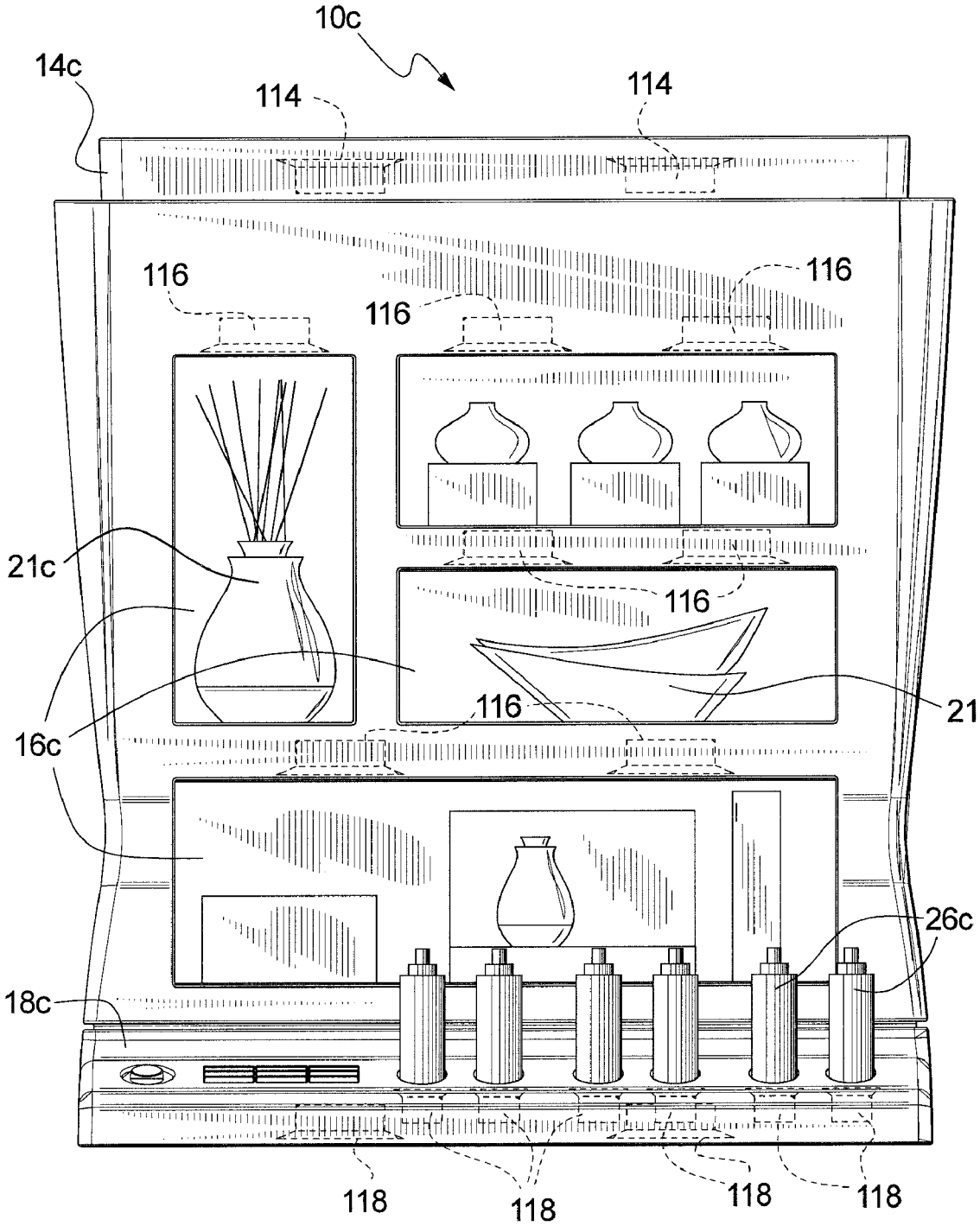
FIG. 7 is a diagrammatic view of dynamic light sources positioned throughout an interior of an illuminating product display.

Turning to the diagram of FIG. 7, a plurality of dynamic light sources may be disposed at various locations throughout an illuminating product display 10*c*. Specifically, a first set of dynamic light sources 114 may be positioned within the an illuminating member 14*c* or crown to emit light upward while a second set of dynamic light sources 116 may illuminate the interior of the lighting niches 16*c*. A third set of dynamic light sources 118 may be provided within the product experience shelf 18*c* to project light up and through the recesses and or down toward the unoccupied shelves. More importantly, the light emitted from all of the dynamic light sources disposed throughout the display 10*c* may be coordinated by the same control module. Specifically, the control module may synchronize light shows between the dynamic light sources so as to provide a unified glow and smooth color transitions. Alternatively, two or more control modules may be provided to synchronize several light shows and control two or more independent groups of dynamic light sources.

Figure 8:
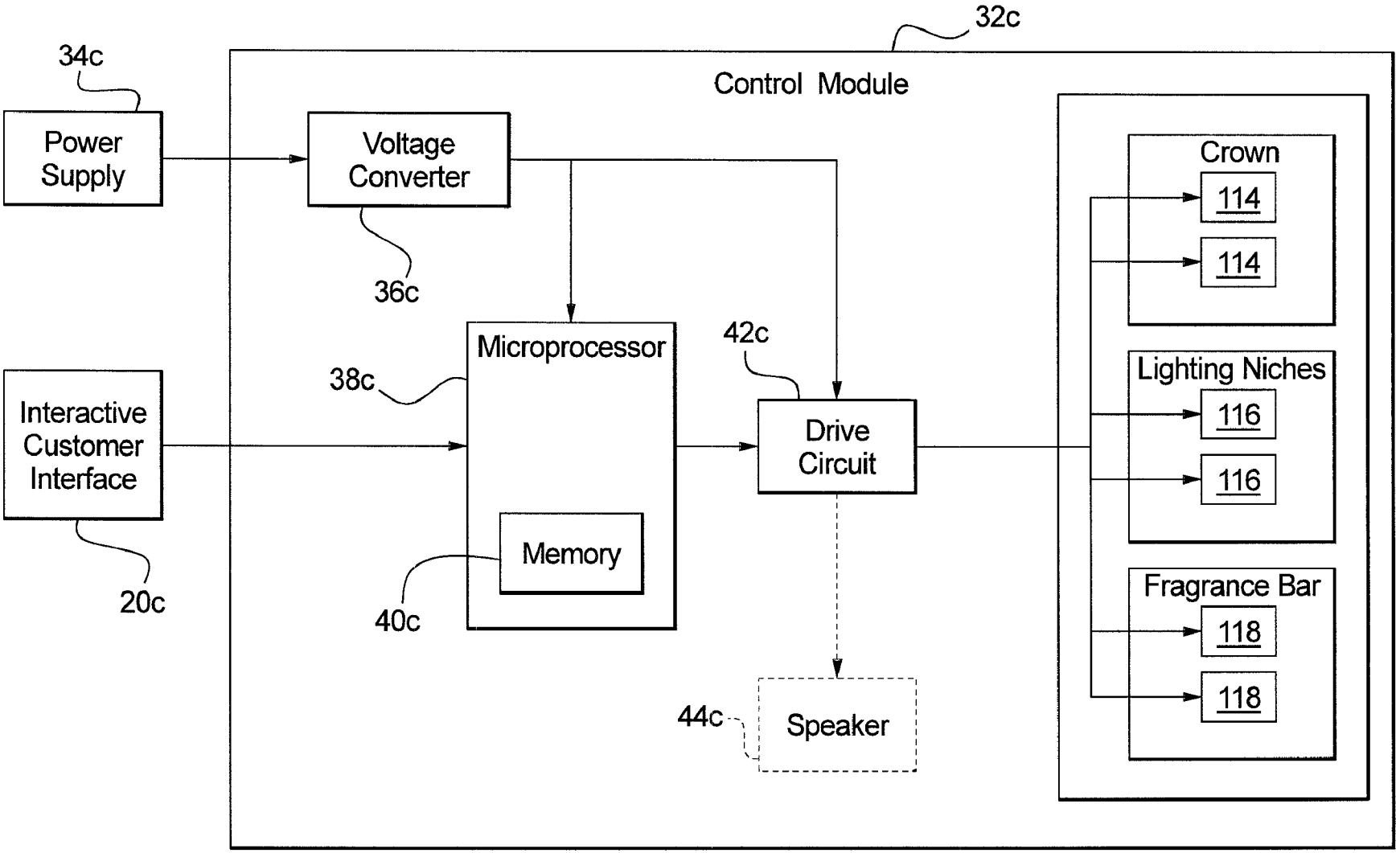
FIG. 8 is a diagrammatic view of an exemplary control module for the illuminating product display of FIG. 7.
Figure 9:
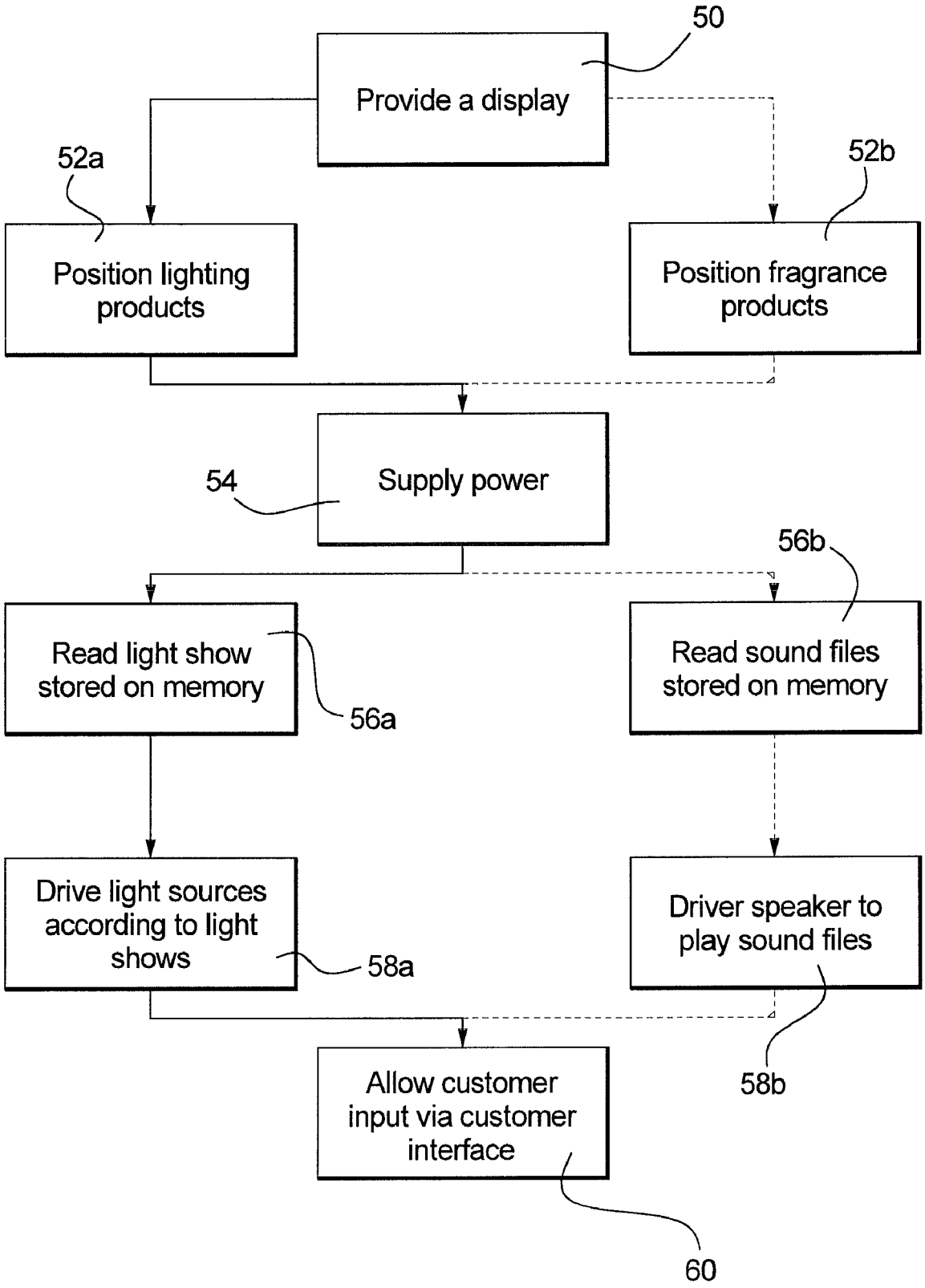
FIG. 9 is a flow chart of a sample sequence of steps which may be practiced in accordance with the method of the present disclosure.

Turning now to FIG. 8, an exemplary control module 32*c* for use with the illuminating product display 10*c* is provided. As shown in the embodiment, power to the control module 32*c* may be provided by a mechanism for connecting to an external power source, for example, an AC plug 34*c*. The AC plug 34*c* may provide an AC input voltage to a voltage converter 36*c*, which may rectify and convert the AC input into a DC signal. Subsequently, the voltage converter 36*c* may distribute the appropriate DC supply to the microprocessor 38*c*, memory 40*c* and driver circuit 42*c*, as required to coordinate light shows.

Light shows may include any predetermined sequence or pattern of lighting that may be performed by the dynamic light sources provided within the display 10*c*. For example, light shows may include pulsing of one color, transitions from one color to another, transitions from one set of colors to another, or any combinations thereof. Alternatively, light shows may also be synchronized with music, nature sounds, sound effects, or other audio output. The microprocessor 38*c* may serve to coordinate such light shows stored on a memory 40*c* internal to the microprocessor 38*c*. Alternatively, the memory 40*c* may be provided as a replaceable cartridge external to the microprocessor 38*c* so as to provide and facilitate light show modifications and other upgrades. The microprocessor 38*c* may read the light shows stored in memory 40*c* and output corresponding instructions to the driver circuit 42*c*. The driver circuit 42*c* may output signals to control the lighting effects of each dynamic light source according to the instructions transmitted by the microprocessor 38*c*. When incorporating audio output, the driver circuit 42*c* may output corresponding signals to a speaker 44*c*, as shown in phantom. The microprocessor 38*c* may also serve to execute instructions input by a customer via the interactive customer interface 20*c*. For instance, if a customer uses the interface 20*c* to select a different color or light show, the microprocessor 38*c* may receive the instruction from the interface 20*c* and adjust its output to the driver circuit 42*c* accordingly.

In an exemplary method of displaying a product 21*c*, a first step 50 may provide the display 10*c* of FIG. 7, for example. The upright display member 12*c* may include a first dynamic light source 116 disposed in lighting niches 16*c*. Alternatively, the upright display member 12*c* may also include second and or third dynamic light sources 118, 114. The second dynamic light source 118 may be disposed in a product experience shelf 18*c* while the third dynamic light source 114 may be disposed in an illuminating member 14*c*. An additional dynamic light source may also be provided within a product 21*c*. The display 10*c* may also include the control module 32*c* of FIG. 8 with a memory 40*c* and an interactive customer interface 20*c* for receiving customer input. The control module 32*c* may be operatively associated with all dynamic light sources positioned throughout the display 10*c*.

In a second step 52*a*, products 21*c*, such as lighting products, may be positioned in the lighting niches 16*c*. As shown in phantom, additional products 26*c*, such as fragrance products, may also be positioned on the product experience shelf 18*c* in an optional step 52*b*. A third step 54 of the method may supply power to the control module 32*c*, and subsequently read one or more light shows stored on the memory 40*c* in a fourth step 56*a*. In a fifth step 58*a*, the dynamic light sources may be controlled to illuminate according to the light shows stored on the memory 40*c*. The light shows may be synchronized between all of the dynamic light sources positioned throughout the display 10*c*. Alternatively, the memory 40*c* may also store sound files which may be read in an optional step 56*b* and subsequently played through an optional speaker 40*c* in a following step 58*b*. A final step 60 may further allow adjustments of the light shows in response to customer input received by the interactive customer interface 20*c*.

Based on the foregoing, it can be seen that the present disclosure provides a method of displaying and merchandising a product which creates an interesting destination for potential customers within a retail environment. The multisensory technology integrated into the display provided by the method attracts customers to a product. Using the embodiments and methods disclosed herein, it is possible to provide a display which coordinates and synchronizes light shows throughout the display and allows customer interaction via an interactive customer interface. Specifically, the method provides a display that allows customers to sample various products at the point of sale. Furthermore, by combining interchangeable modules of the display, the method is adaptable to accommodate any product, product line or retail environment.

While only certain embodiments have been set forth, alternatives and modifications will be apparent from the above description to those skilled in the art. These and other alternatives are considered equivalents and within the spirit and scope of this disclosure.

What is claimed is:

1. A method of displaying a product, comprising the steps of:

providing an upright display member having at least one lighting niche, a first dynamic light source disposed in the at least one lighting niche for projecting light onto the product, a second dynamic light source disposed in the product for illuminating the product, a control module with a memory operatively associated with the first and second dynamic light sources, and an interactive customer interface for receiving customer input;

positioning the product inside the at least one lighting niche;

supplying power to the control module;

reading one or more light shows stored on the memory;

controlling the first and second dynamic light sources to illuminate according to the one or more light shows; and adjusting the one or more light shows in response to the customer input.

2. The method of claim 1 further comprising the steps of:

providing an illuminating member disposed on an exterior surface of the upright display member, a third dynamic light source disposed in the illuminating member, the control module operatively associated with the third dynamic light source;

controlling the third dynamic light source to illuminate according to the one or more light shows; and synchronizing the one or more light shows between the first, second and third dynamic light sources.

3. The method of claim 1, wherein each of the first and second dynamic light sources comprises a plurality of colored LEDs.

4. The method of claim 1, wherein the memory is removable from the control module.

5. The method of claim 1, wherein the memory stores at least three light shows.

6. The method of claim 1, wherein the upright display member further comprises a removable cover.

7. A method of displaying a product, comprising the steps of:

providing an upright display member having at least one lighting niche, a first dynamic light source disposed in the at least one lighting niche, a control module with a memory operatively associated with the first dynamic light source, and an interactive customer interface for receiving customer input;

positioning the product inside the at least one lighting niche;

supplying power to the control module;

reading one or more light shows stored on the memory;

controlling the first dynamic light source to illuminate according to the one or more light shows; and adjusting the one or more light shows in response to the customer input.

8. The method of claim 7 further comprising the steps of:

providing a second dynamic light source in the product for projecting light upwardly through the product, the control module operatively associated with the second dynamic light source;

controlling the second dynamic light source to illuminate according to the one or more light shows; and synchronizing the one or more light shows between the first and second dynamic light sources.

9. The method of claim 7 further comprising the steps of:

providing an illuminating member disposed on an exterior surface of the upright display member, a third dynamic light source disposed in the illuminating member, the control module operatively associated with the third dynamic light source;

controlling the third dynamic light source to illuminate according to the one or more light shows; and synchronizing the one or more light shows between the first and third dynamic light sources.

10. The method of claim 7, wherein the first dynamic light source comprises a plurality of colored LEDs.

11. The method of claim 7, wherein the memory is removable from the control module.

12. The method of claim 7, wherein the memory stores at least three light shows.

13. The method of claim 7, wherein the adjustment of the one or more light shows is performed by rotating a dial of the customer interface.

14. The method of claim 7 further comprising the steps of:

reading a sound file stored on the memory; and playing the sound file through a speaker.

15. The method of claim 7, wherein the upright display member further comprises a removable cover.

16. A method of displaying products, comprising the steps of:

providing an upright display member having at least one lighting niche, a product experience shelf, a first dynamic light source disposed in the at least one lighting niche, a second dynamic light source disposed in the product experience shelf, a control module with a memory operatively associated with the first and second dynamic light sources, and an interactive customer interface for receiving customer input;

positioning a first product inside the at least one lighting niche and a second product on the product experience shelf;

supplying power to the control module;

reading one or more light shows stored on the memory;

controlling the first and second dynamic light sources to illuminate according to the one or more light shows;

synchronizing the one or more light shows between the first and second dynamic light sources; and adjusting the one or more light shows in response to the customer input.

17. The method of claim 16 further comprising the steps of:

providing a third dynamic light source in the first product for projecting light upwardly through the first product, the control module operatively associated with the third dynamic light source;

controlling the third dynamic light source to illuminate according to the one or more light shows; and synchronizing the one or more light shows between the first, second and third dynamic light sources.

18. A method of merchandising products, comprising the steps of:

providing an upright display member having at least one lighting niche, a product experience shelf, an illuminating member disposed on top of the upright member, a first dynamic light source disposed in the at least one lighting niche, a second dynamic light source disposed in the product experience shelf, a third dynamic light source disposed in the illuminating member, a control module with a memory operatively associated with the first, second and third dynamic light sources, and an interactive customer interface for receiving customer input;

positioning a first product inside the at least one lighting niche and a second product on the product experience shelf;

supplying power to the control module;

reading one or more light shows stored on the memory;

controlling the first, second and third dynamic light sources to illuminate according to the one or more light shows;

synchronizing the one or more light shows between the first, second and third dynamic light sources; and adjusting the one or more light shows in response to the customer input.

19. The method of claim 18 further comprising the steps of:

providing a fourth dynamic light source disposed in the first product for projecting light upwardly through the first product, the control module operatively associated with the fourth dynamic light source;

controlling the fourth dynamic light source to illuminate according to the one or more light shows; and synchronizing the one or more light shows between the first, second, third and fourth dynamic light sources.

20. The method of claim 18, wherein the adjustment of the one or more light shows is performed by rotating a dial of the customer interface.

* * * * *